US008123663B2

(12) United States Patent
Fey et al.

(10) Patent No.: US 8,123,663 B2
(45) Date of Patent: Feb. 28, 2012

(54) EXERCISE APPARATUS AND APPAREL

(76) Inventors: Edward G. Fey, Boston, MA (US); Michael R. D'Angelo, Boston, MA (US)

( * ) Notice: Subject to any disclaimer, the term of this patent is extended or adjusted under 35 U.S.C. 154(b) by 212 days.

(21) Appl. No.: 12/226,161

(22) PCT Filed: Apr. 9, 2007

(86) PCT No.: PCT/US2007/008664

§ 371 (c)(1),
(2), (4) Date: Jun. 11, 2009

(87) PCT Pub. No.: WO2007/120584

PCT Pub. Date: Oct. 25, 2007

(65) Prior Publication Data

US 2010/0004099 A1 Jan. 7, 2010

Related U.S. Application Data

(60) Provisional application No. 60/790,964, filed on Apr. 11, 2006.

(51) Int. Cl.
*A63B 21/00* (2006.01)

(52) U.S. Cl. ..... 482/112; 482/111; 482/113

(58) Field of Classification Search ..... 482/99, 482/111–113, 130, 140, 148; 601/152
See application file for complete search history.

(56) References Cited

U.S. PATENT DOCUMENTS

| | | | | |
|---|---|---|---|---|
| 6,258,014 | B1 | 7/2001 | Karecki | |
| 6,656,097 | B2 | 12/2003 | Karecki | |
| 2005/0079964 | A1 * | 4/2005 | Francavilla | 482/142 |
| 2008/0076649 | A1 * | 3/2008 | Chen | 482/140 |
| 2008/0081749 | A1 * | 4/2008 | Wolff | 482/130 |
| 2009/0264265 | A1 * | 10/2009 | Contreras | 482/99 |
| 2010/0210977 | A1 * | 8/2010 | Casha | 601/5 |

OTHER PUBLICATIONS

International Search Report from PCT/US2007/008664, completed Nov. 24, 2007, mailed Dec. 3, 2007.
International Preliminary Report on Patentability from PCT/US2007/008664, issued Oct. 14, 2008.
Written Opinion of the International Searching Authority from PCT/US2007/008664, completed Nov. 24, 2007, mailed Dec. 3, 2007.

* cited by examiner

*Primary Examiner* — Glenn Richman
(74) *Attorney, Agent, or Firm* — Clark & Elbing LLP

(57) ABSTRACT

The invention provides an exercise apparatus containing a compressible member, which provides physical instability and improves core muscle development in an exercising person. In addition, the invention provides an article of clothing containing a compressible member or material which provides physical instability to a person performing active or passive exercise.

12 Claims, 8 Drawing Sheets

EXERCISE APPARATUS AND APPAREL

CROSS-REFERENCE TO RELATED APPLICATIONS

The present application is the U.S. National Stage of International Application No. PCT/US2007/08664, filed Apr. 9, 2007, which claims the benefit of U.S. Provisional Application Ser. No. 60/790,964, filed Apr. 11, 2006.

FIELD OF THE INVENTION

This invention relates generally to the field of physical exercise and, particularly, to a compressible cushion attached or fitted to a seat or bench of an exercise apparatus and an article of clothing, both of which provide physical instability to an exercising person.

BACKGROUND OF THE INVENTION

Individuals interested in strength training typically use exercise equipment such as plate-loaded or weight-stack machines, multi-station machines, circuit-training machines, or flat, upright, inclined, or declined benches. The purpose of strength training using machines is the exercise of individual muscle groups. Proper form and focus are important in isolating the appropriate muscle groups and preventing injury. However, if an exercising person primarily concentrates on strength training for overall personal fitness through standard weight lifting, exercise of the core muscles, such as the back and abdominal muscles, is often overlooked. Strong core muscles provide increased protection and bracing for the back, controlled movements, a more stable center of gravity, and a more stable platform for sports movements. Thus, this invention would help to prevent injury as well as improve overall personal fitness by requiring heightened muscle control and improved balance of the exercising person.

SUMMARY OF THE INVENTION

In one aspect, the present invention provides an exercise apparatus featuring a support member, for support of a portion of the upper and/or lower body, fitted with a compressible member, and a means for providing strength-enhancing physical resistance when the exercise apparatus is in use. The support member can be oriented in such a way as to provide for exercise in a flat, upright, inclined, or declined position. The compressible member fitted to the support member causes physical instability of the exercising person and requires simultaneous use of core muscles to maintain balance and proper form.

In one embodiment of the invention, the exercise apparatus includes a support member and compressible member wherein the instability caused by the compressible member requires continuous adjustment of the abdominal muscles and forces improved muscular control and concentrated muscular contraction. In another desirable embodiment, the exercise apparatus includes a support member and compressible member wherein the instability caused by the compressible member requires continuous adjustment of the back muscles.

In one embodiment, the exercise apparatus includes support members for both the back torso and buttocks. In another desirable embodiment, the exercise apparatus includes a support member for the front torso (chest) and buttocks. In yet another desirable embodiment, the exercise apparatus includes a support member for the lower body or buttocks. In yet another desirable embodiment, the exercise apparatus includes a support member for the upper body or back.

In different embodiments of the invention, the exercise apparatus is an exercise machine dedicated to a press exercise or seated rowing exercise, a lat machine, a strength-training machine, a weight-stack machine, a multi-station machine, a circuit-training machine, cardiovascular equipment, or a bench.

The present invention provides for a compressible member which is constructed such that, when the apparatus is in use during exercise, the compressible member causes physical instability of the exercising person during performance of the resistance-based exercise and requires simultaneous use of core muscles to maintain balance and proper form.

The compressible member of the invention consists of a durable exterior shell with an interior containing a liquid, gel or gas, e.g. air, or combinations thereof. In one desirable embodiment, the volume and/or pressure inside the compressible member containing a liquid, gel or gas may be changed to allow for varying levels of stability while performing exercises. In another desirable embodiment, the compressible member is available, or packaged for sale, as one or more pads with different degrees of thickness and/or compressibility. The compressible member may replace support members or may be placed over existing support members.

The invention further features a method of enhancing exercise on an exercise apparatus by utilizing a compressible member to overlie a support member, wherein the instability caused by the compressible member requires continuous adjustment of the abdominal muscles by the exercising person during performance of the resistance-based exercise. In different embodiments of the method, the exercise apparatus is a press exercise or seating rowing exercise, a lat machine, a strength-training machine, a plate-loaded machine, a weight-stack machine, a multi-station machine, a circuit-training machine, cardiovascular equipment, or a bench.

In another aspect, the invention provides an article of clothing including a compressible member, wherein the compressible member is positioned to contact a portion of the torso and/or buttocks of a person, when the person is using strength-enhancing physical resistance equipment, wherein the compressible member causes physical instability that requires continuous adjustment of the person's core muscles.

A preferred article of clothing is a vest featuring a compressible member, which covers the upper (front, back or sides) and/or lower body (lower back and buttocks), fitted with a compressible material as a means for providing strength enhancing physical resistance when wearing the vest. The compressible member(s) in the clothing (e.g., vest) will be oriented in such a way as to 1) provide for exercise in a flat, upright, inclined, declined, seated upright or prone position, and/or 2) exercise specific muscle groups including: abdominal/core muscles; back and side muscles; back muscles; back and torso muscles; chest and buttock muscles; or upper body and back muscles.

In one embodiment, the rigidity of the compressible member(s) can be manually adjusted or programmed to change during the exercise to alter the level of instability during exercise. In a related embodiment, the compressible member(s) can be physically rearranged or programmed to provide instability to different locations in the clothing, which allows exercise of different muscle groups.

In another embodiment, the clothing contains a compressible member which contains a semi-rigid plastic material. In related embodiments, the clothing contains multiple compressible members which can be physically rearranged by the individual or by a small motor built into the clothing, to provide instability to different locations in the clothing, which allows exercise of different muscle groups.

In another embodiment, the clothing contains a device that provides varying levels of vibration (i.e., vibration element). These vibrations will radiate through the clothing and provide another level of instability in the presence or absence of additional compressible members. The vibration element can be manually adjusted or programmed to provide continuous or adjustable instability to a person exercising. In another embodiment, the vibration element can be programmed or adjusted to promote destabilization of different muscles during exercise.

The clothing can be made of cloth, cotton, GoreTex®, spandex, or some other material. There can be a number of different compressible members on the front, back, or sides of the garment and their location range from the neck down to below the buttocks. The clothing can also be provided in different colors and designs. The individual compressible members of the clothing can also be provided or packaged for sale, with different degrees of rigidity and/or compressibility. The vibration element of the clothing can also be provided or packaged for sale to provide steady or adjustable levels of vibration.

The purpose of strength training is the exercise of individual muscle groups and preventing injury. A disadvantage of focusing on strength training for overall personal fitness is that exercise of the core muscles, such as the back and abdominal muscles, is often neglected. Strong core muscles provide increased protection and bracing for the back, controlled movements, a more stable center of gravity, and an improved physiognomy for sports movements. The present invention will help to prevent both sports-related and occupational injuries, as well as improve overall fitness by requiring heightened muscle control and improved balance of the exercising person.

By "support member" is meant conventional pads or seats on fitness equipment.

By "compressible member" is meant a pad(s) within or attached to a vest or clothing for fitness training. The pad or cushion will have a fitted outer covering or shell that a person can wear, with an interior containing a liquid, gel, gas, e.g. air, or semi-rigid plastic material, or combinations thereof. The pads can be a variety of geometric shapes and sizes depending upon their location in the garment. The pads in the garment can also be vertical or horizontally sewn or affixed to the fabric. The fabric can be cloth, cotton, GoreTex®, spandex, or some other material. There can be a number of different pads on the front, back, or sides of the garment and their location range from the neck down to below the buttocks. The pads can also be exchangeable, such that their location on the garment can be altered to exercise a particular muscle group.

The term "compressible member" also includes a pad or seat with a fitted outer covering or shell, and with an interior containing a liquid, gel or gas, e.g. air, or combinations thereof. A compressible member may replace support members or may be placed over existing support members on an exercise apparatus.

By "compressible" is meant capable of being deformed by pressure or the weight of a human body engaged in exercise, i.e., squeezable.

By "exercise apparatus" is meant an exercise machine dedicated to a press exercise or seated rowing exercise, a lat machine, strength-training equipment, both plate-loaded as well as weight-stack machines, a multi-station machine; a circuit-training machine; cardiovascular equipment such as a rowing machine or bike; or a flat, upright, inclined or declined bench for free weight exercises.

The invention is based on the known physiological fact that exercising the body's multitude of core muscles, each of which is located about the thoracic cavity/torso and pelvis area, is an important component of overall fitness training. The use of the compressible member would lead to improved neurological, neuromuscular control of all muscles being trained and conditioned, particularly the core muscles. A strong core provides increased protection and bracing for the back, controlled movements, a more stable center of gravity, and a more stable platform for sports movements. When a person has good core stability, the muscles in the pelvis, lower back, hips and abdomen work in harmony. A weak core can make a person susceptible to poor posture, lower back pain, and muscle injuries. A strong core provides the brace of support needed to help prevent such pain and injury, and provides a preventive health initiative.

Thus, the present invention also provides a method for enhancing exercise on an exercise apparatus by providing a compressible member which is constructed such that, when the apparatus is in use during exercise, the compressible member causes physical instability of the exercising person during performance of the resistance-based exercise and requires simultaneous use of core muscles to maintain balance and proper form.

The invention combines strength training and a good core workout into one exercise module. The operator, while engaging in exercise on such an apparatus or wearing such an article of clothing, would condition and stabilize core muscles while strengthening individual muscle groups. This combination of strength training and core exercise would lead to an improved strength workout for the exercising person.

Figure 1:
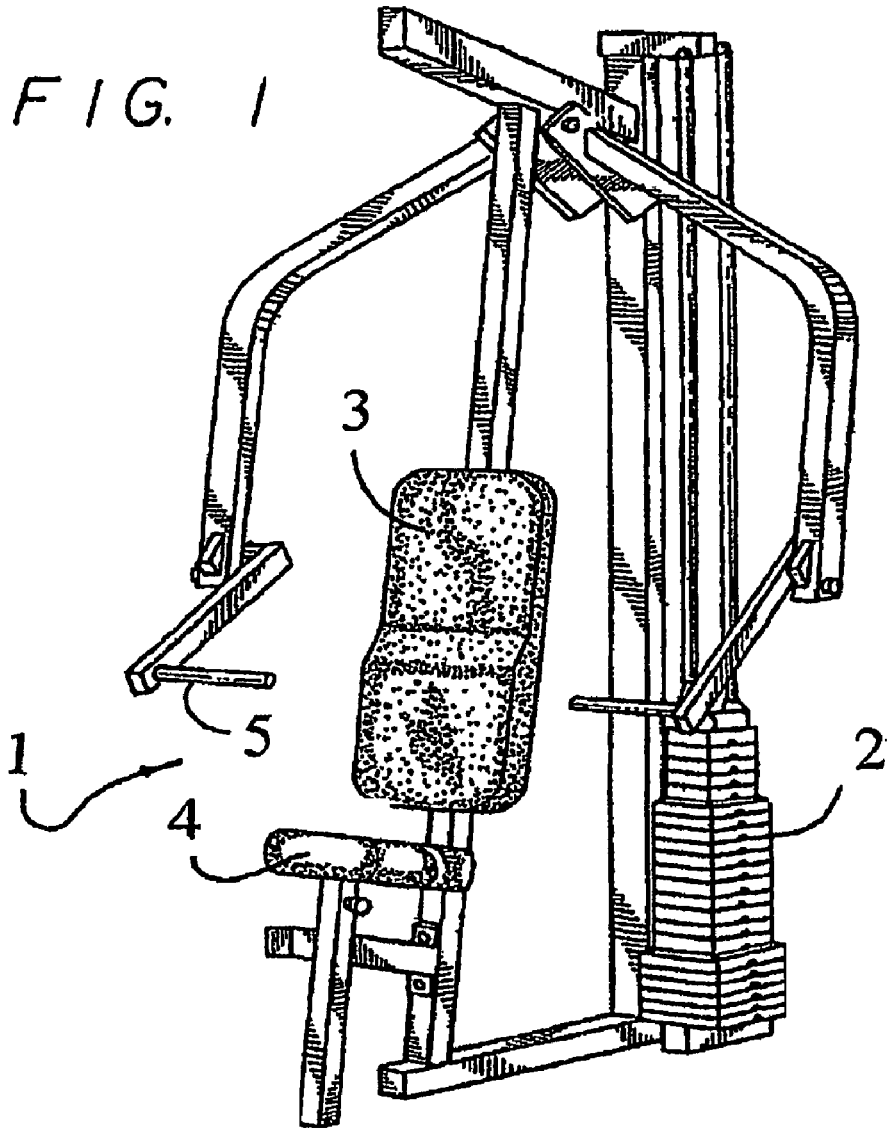
FIG. 1 is a perspective view of an exercise apparatus constructed in accordance with the present invention.

(The Figure was adapted from FIG. 1 of U.S. Pat. No. 5,971,895, assigned to Precor Inc., hereby incorporated by reference).

FIGS. 2-8 are drawing of different vests of the invention.

DETAILED DESCRIPTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Exercise Apparatus

An exercise apparatus 1 constructed in accordance with the present invention is shown in FIG. 1. The exercise apparatus includes two support members 3 and 4, for the torso and buttocks respectively, fitted with a compressible member, and a selectable weight-stack 2 for providing strength-enhancing upper body physical resistance when the exercise apparatus is in use. Other sources of exercise resistance may also be utilized, including individual weight plates, hydraulic, pneumatic, and electromagnetic or friction mechanisms, or even the operator's own weight. Although, for the sake of clarity, the present invention is illustrated as an exercise machine dedicated to a press exercise, it is to be understood that the invention may also be embodied as a exercise machine dedicated to seated rowing exercises, a lat machine used for lat pull-down or low-row exercises, a plate-loaded machine; a multi-station machine; a circuit-training machine; cardiovascular equipment such as a rowing machine or bike; or a flat, upright, inclined, or declined bench for free weight exercises.

The apparatus features support members 3 and 4 fitted with a compressible member. The exterior of the compressible member may be composed of a durable material, such as plastic, synthetic fiber, or synthetic leather. The compressible member contains a liquid, gel or gas, e.g. air, or combinations thereof. Examples of gels which can be used to fill the compressible member are described in, but not limited to, U.S. Pat. Nos. 5,334,646; 5,994,450; 5,766,704; and 4,744,601; herein incorporated by reference. In one preferred embodiment, the volume and/or pressure inside the compressible member may be changed to allow for varying levels of stability while performing exercises. The compressible member may replace support members or may be temporarily or permanently placed over existing support members. A removable compressible member may be affixed to the support member using, but not limited to, snaps, Velcro®, and/or straps. A compressible member may be permanently affixed to the support member by way of, but not limited to, sewing and/or gluing the compressible member to the support member.

The operator of the exercise apparatus performs the exercise by pushing both outwardly and upwardly against the handgrips 5. The compressible member fitted to the support members 2 and 3 causes physical instability of the exercising person and requires simultaneous use of core muscles, such as the back and abdominal muscles, to maintain balance and proper form. As the operator continues to exercise, the workout strengthens both the primary chest muscle as well as the secondary core muscles. Exercising on an unstable surface allows the operator to condition the body while improving neuromuscular control and focus during exercise, developing added protection and bracing for the back and spine, and enabling a more stable center of gravity. Strengthening the core muscles provides the brace of support needed to help prevent future injury and pain. Using the compressible member during exercise would prevent the operator from using too much weight, which in turn would help the operator to better execute form and control of all movements via neuromuscular coordination and proprioception, thus reducing the risk of injury.

The compressible member can be available as a fitted covering to existing fitness equipment, or as a seat or cushion to replace existing fitness equipment. The compressible member would be available in a range of colors, sizes, moulds, and range in degrees of thickness and compressibility. The invention would be sold, but not limited, to health clubs, physical therapists hospitals, and all fitness equipment manufacturers. As an exercise component, the compressible member would serve to enhance general fitness, physical conditioning, strength training and/or rehabilitation of the exercising person.

Exercise Clothing

The invention also provides a article of clothing (e.g., a vest), which covers the upper (front, back or sides) and/or lower body (lower back and buttocks), fitted with one or more compressible members as a means for providing strength enhancing physical resistance when wearing the clothing. The compressible members may be oriented in such a way as to promote the exercise of specific muscle groups including: abdominal/core muscles; back and side muscles; back muscles; back and torso muscles; chest and buttock muscles; or upper body and back muscles. Specific examples of clothing of the invention are provided below.

Figure 2:
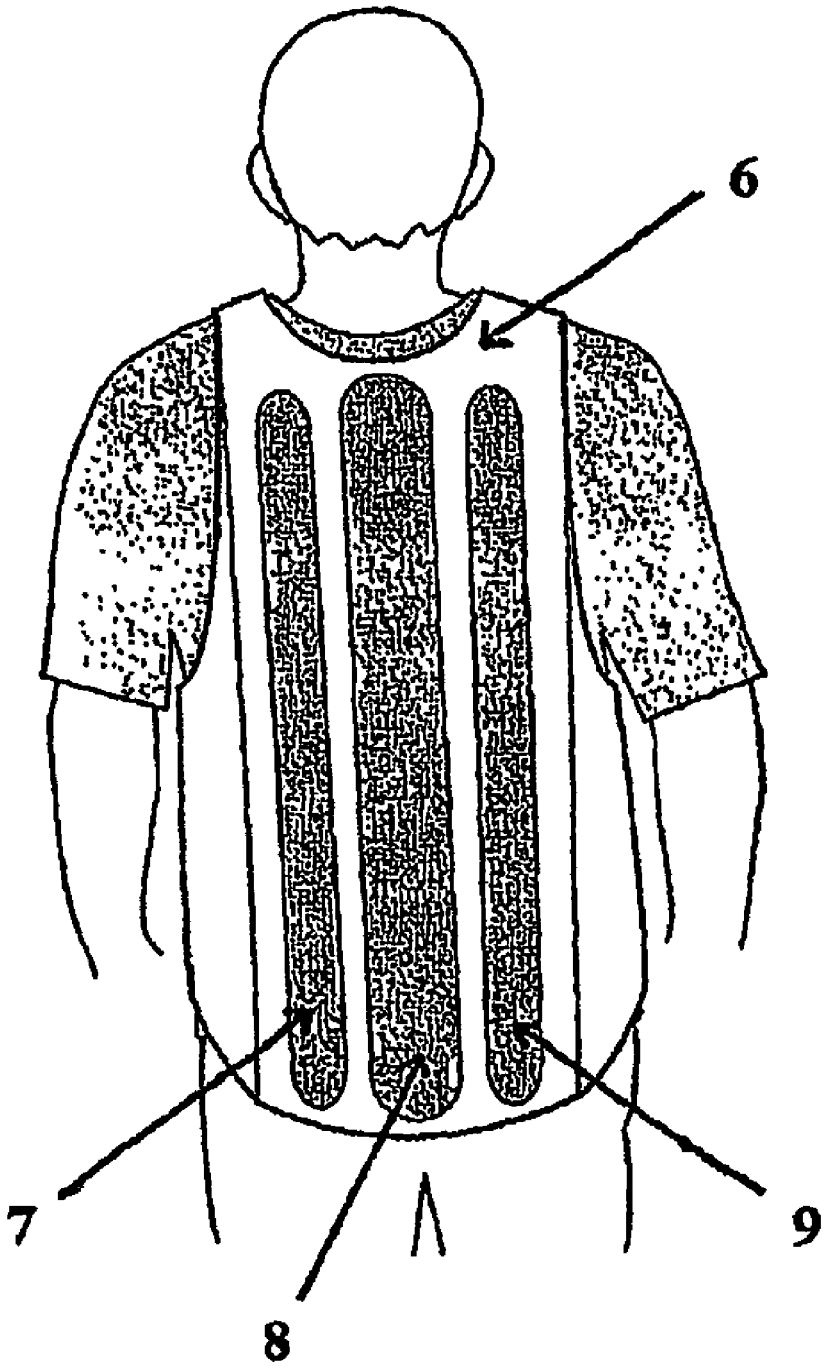

Referring to FIG. 2, vest 6 contains three vertically placed, elongated compressible members 7, 8, and 9 on the back surface of the vest.

Figure 3:
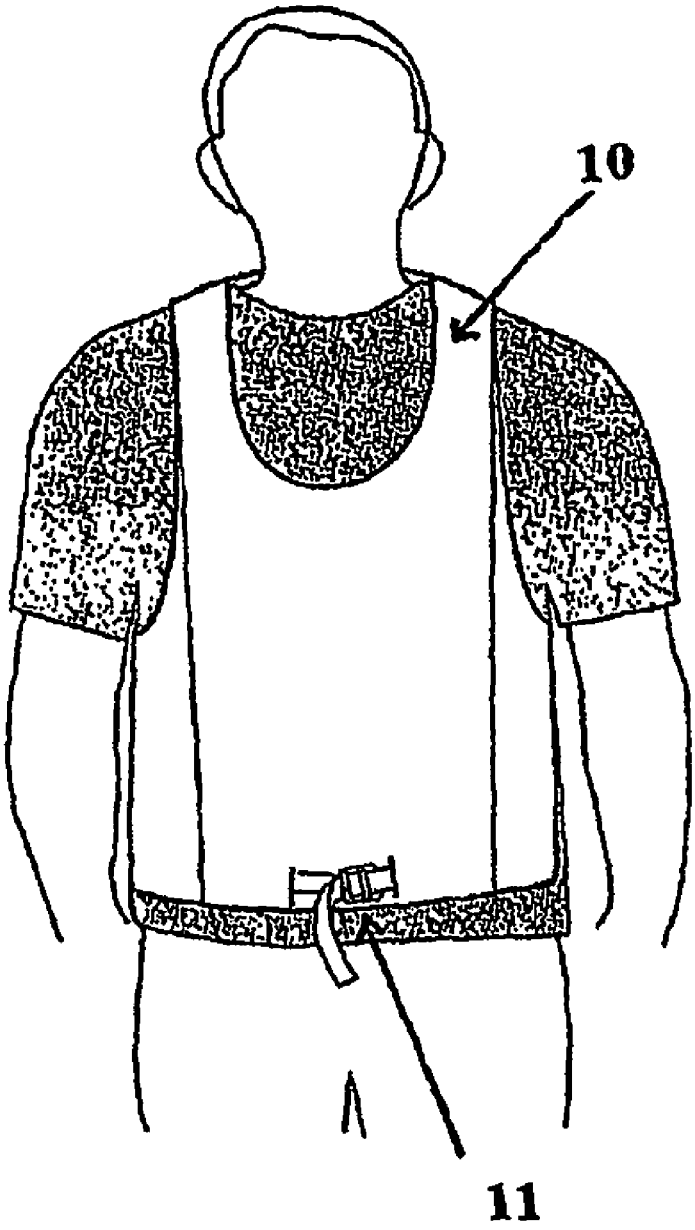

Referring to FIG. 3, vest 10 has a buckle 11, on the front surface of the vest, which allows the vest to be adjusted to fit an individual.

Figure 4:
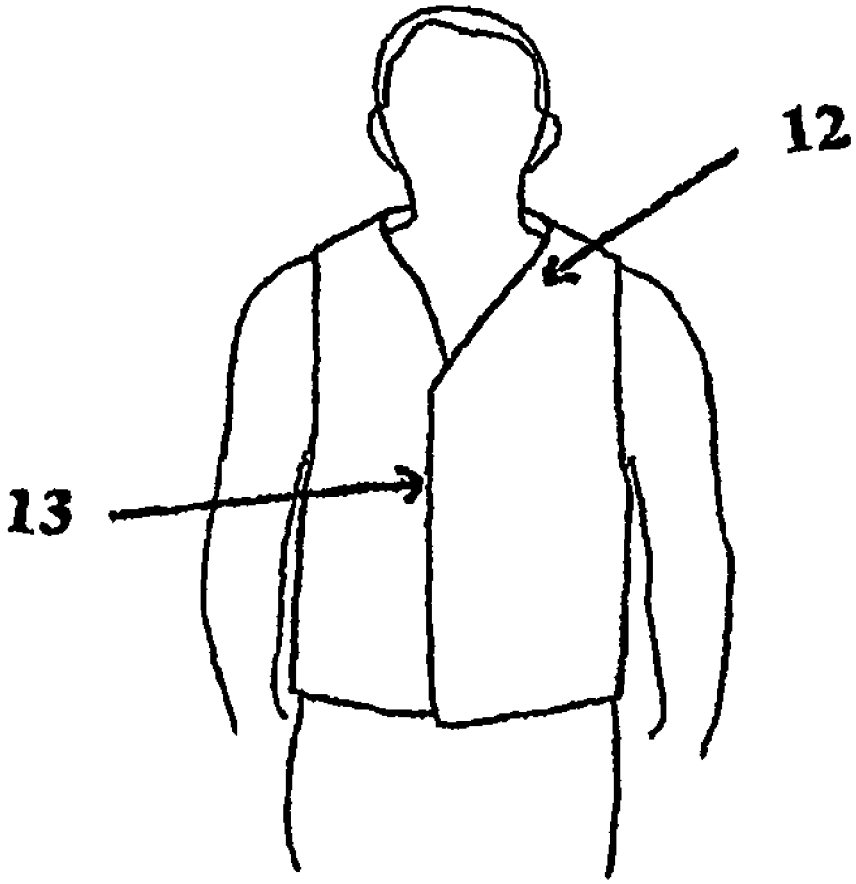

Referring to FIG. 4, vest 12 wraps around an individual, and is closed on the front surface of the vest by a zipper or Velgro® 13.

Figure 5:
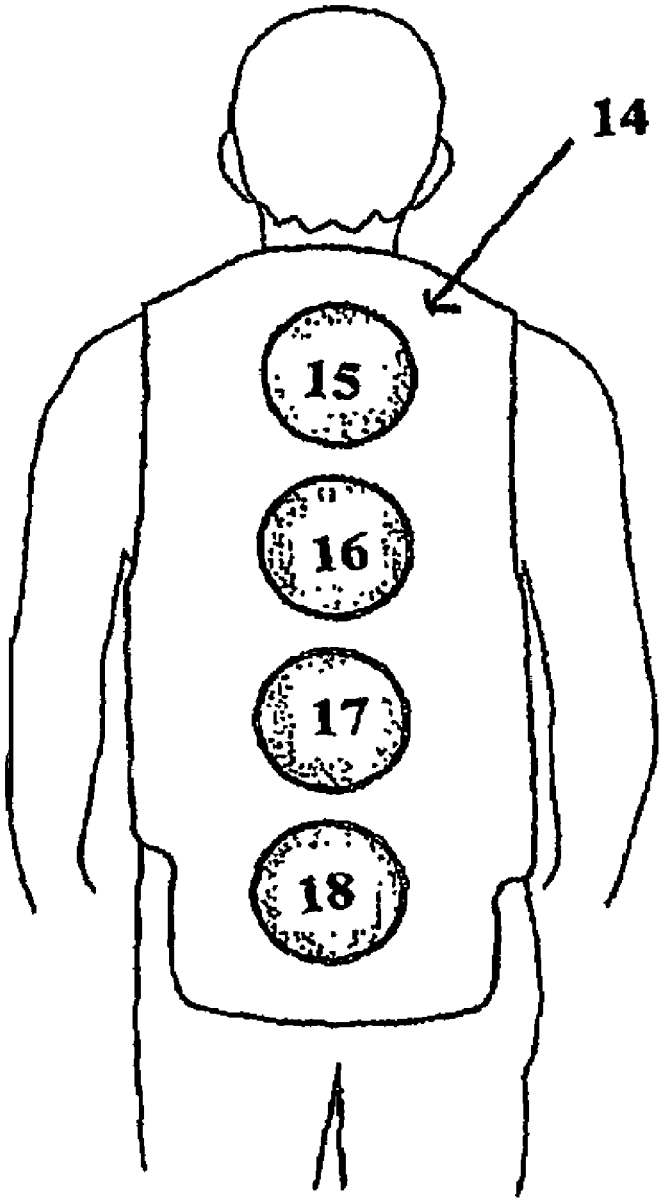

Referring to FIG. 5, vest 14 contains four vertically placed, circular compressible members 15, 16, 17, and 18, on the back surface of the vest.

Figure 6:
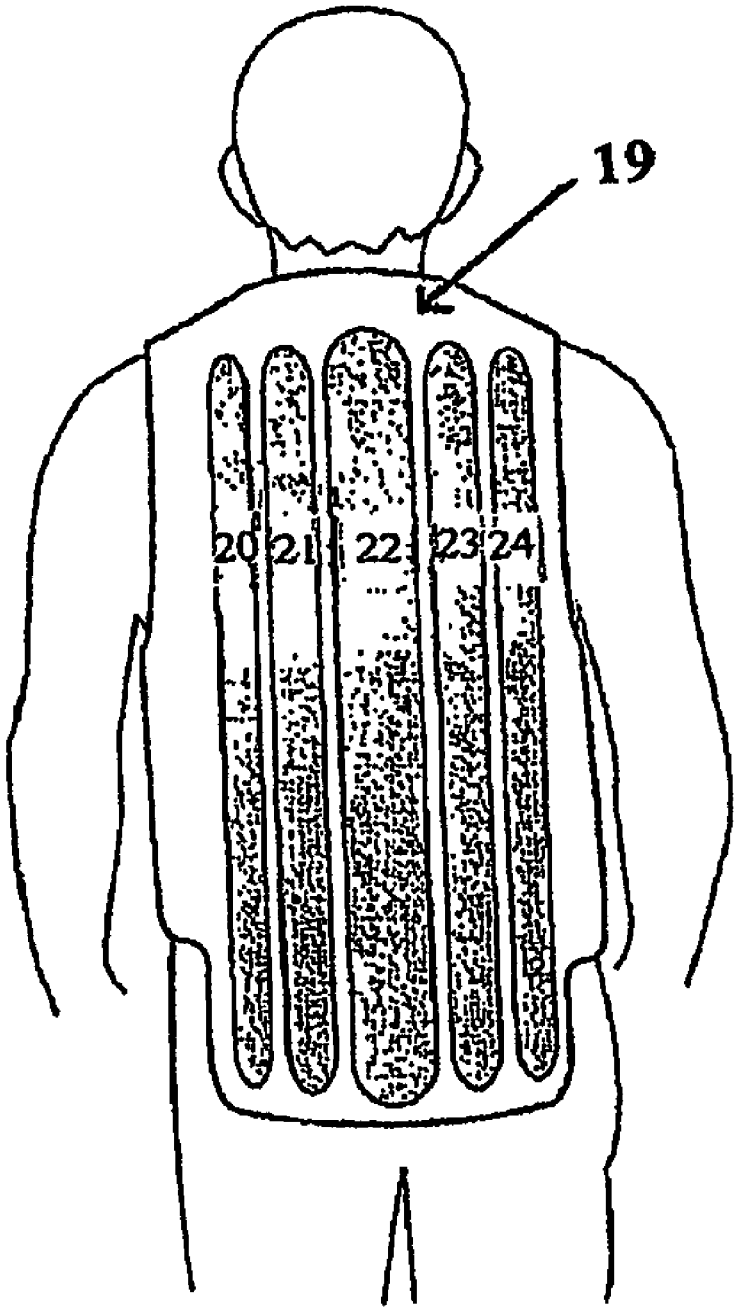

Referring to FIG. 6, vest 19 contains five vertically placed, elongated compressible members 20, 21, 22, 23, and 24, on the back surface of the vest.

Figure 7:
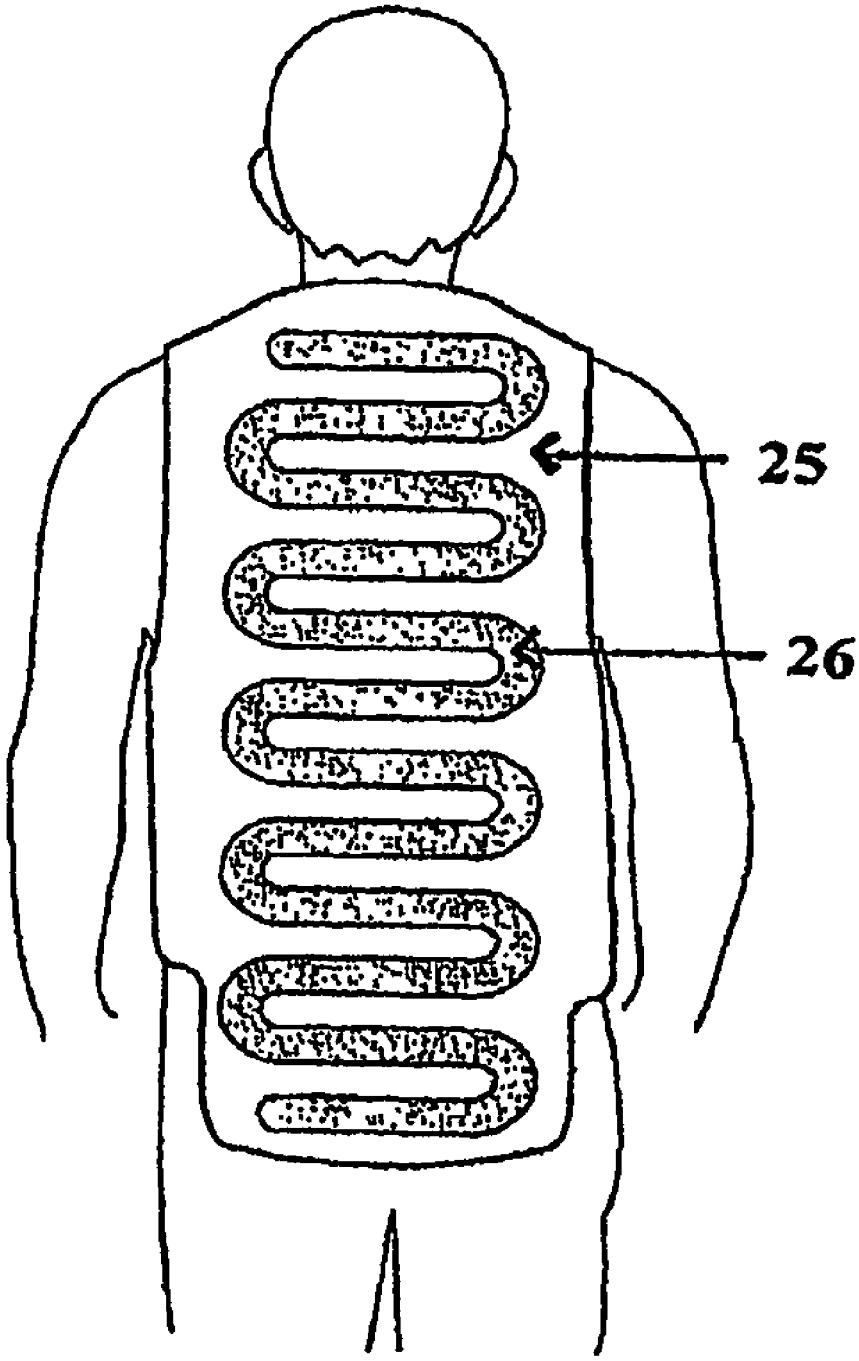

Referring to FIG. 7, vest 25 contains one vertically placed, serpentine compressible member 26, on the back surface of the vest.

Figure 8:
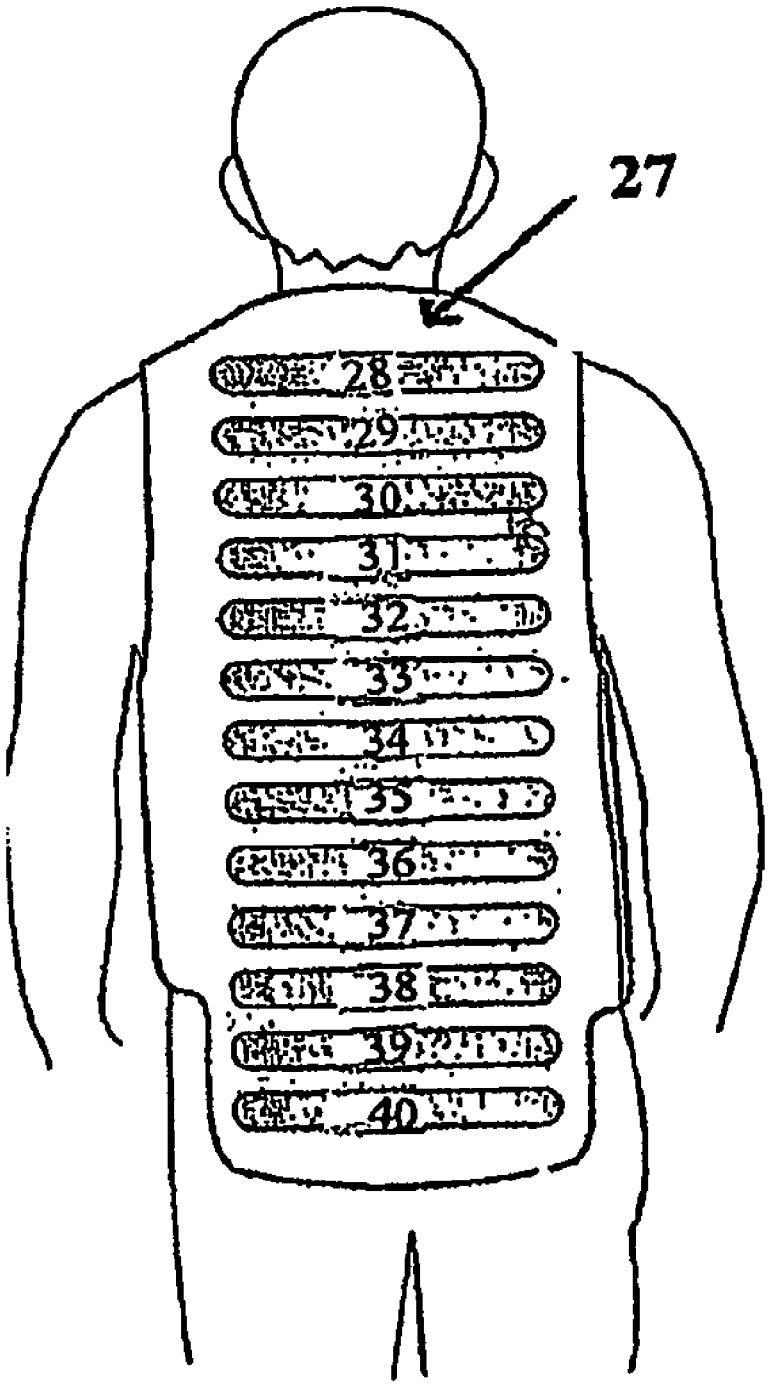

Referring to FIG. 8, vest 27 contains thirteen horizontally placed, linear compressible members 28-40, on the back surface of the vest.

Fabrics and Composition

The fabric of the clothing can be cloth, cotton, GoreTex®, spandex, or some other material. The exterior of the compressible members within the clothing will be composed of a durable material, such as plastic, synthetic fiber, or synthetic leather. The compressible member contains a liquid, gel, gas, e.g. air, or semi-rigid plastic material, or combinations thereof. Examples of gels which can be used to fill the compressible member are described in, but not limited to, U.S. Pat. Nos. 5,334,646; 5,994,450; 5,766,704; and 4,744,601; herein incorporated by reference. In another embodiment, the compressible member(s) will be repositioned on the garment by using, but not limited to, snaps, Velcro®, and/or straps. Compressible member(s) may also be permanently affixed to the clothing by way of, but not limited to, sewing and/or imbedding the compressible member(s) or material within the fabric of the clothing.

Stability Control

In one embodiment, the volume and/or rigidity of the compressible member(s) will be changed to allow for varying levels of stability while performing exercise. The changes in stability will be controlled manually or programmed to exercise a specific muscle group during a particular activity.

In addition, the compressible members may be programmed or physically rearranged to different locations within the clothing, to promote destabilization of different muscles during an exercise.

The clothing of the invention may include one or more compressible members in the presence or absence of a vibration element (described below).

Vibration Element

The clothing can also contain a component (i.e., vibration element) that will produce vibrations in specific locations. The vibration element can be utilized in the presence or the absence of additional compression members.

The vibration element can be programmed such that the intensity and distribution of the vibrations can be manually altered or programmed to exercise specific muscle groups. In addition, the vibration element may provide pulsating vibration or continuous vibration that may be manually adjusted or programmed.

Design and Commercialization

The clothing of the invention will be available in a range of colors, styles, and sizes, and range in the degree of thickness or compressibility. The clothing can be sold in a variety of embodiments, including placement of the compression members and/or vibration element, such that individual muscle groups will be exercised. In one embodiment, the thickness or compressibility of the compression members can be altered by the operator or sold individually in varying degrees of compressibility. The invention can be sold, but not limited, to individuals, health clubs, physical therapists, athletic trainers, hospitals, and fitness equipment manufacturers. As a piece of fitness apparel, the clothing (e.g., a vest) will serve to enhance general fitness, physical conditioning, strength training and/or rehabilitation of the exercising person.

In addition, individual compressible members for insertion into the clothing of the invention, may be packaged for sale in different levels of compressibility, colors, shapes, sizes, and geometric designs. In addition, different vibration elements to be placed within the clothing of the invention, may be sold separately with different vibrational intensities, shapes, periodicity (e.g., pulsating versus continuous vibration), or with regulatory control (e.g., to allow adjustable instability).

Advantages

The invention takes advantage of the known physiological fact that exercising the body's multitude of core muscles, each of which is located about the thoracic cavity/torso and pelvis area, is an important component of overall fitness training. The use of the compressible member will lead to improved neurological, neuromuscular control of all muscles being trained and conditioned, particularly the core muscles. A strong core provides increased protection and bracing for the back, controlled movements, a more stable platform for sports movements. When a person has good core stability, the muscles in the pelvis, lower back, hips and abdomen work in harmony. A weak core can make a person susceptible to poor posture, lower back pain, and muscle injuries. A strong core provides a preventive health initiative.

Thus, the present invention provides a method for enhancing strength training exercise performed both individually and on athletic equipment; by providing a compressible member which causes instability of the exercising person during the performance of resistance-based exercise.

The invention combines strength training and a good core workout into one exercise module. The operator, while engaging in various forms of strength training exercise, will condition and stabilize core muscles while strengthening individual muscle groups. This combination of strength training and core exercise will lead to an improved strength workout for the exercising person.

It should be recognized that the above invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An exercise apparatus comprising:

(a) a support member comprising a pad or seat for supporting at least a portion of the torso or buttocks, or both, of a person who is exercising;

(b) means associated with said support member for providing strength-enhancing physical resistance when used for exercise by said person; and (c) a compressible member overlying at least a portion of the support member, said compressible member being constructed such that, when said apparatus is in use during exercise, said compressible member causes physical instability that requires continuous adjustment of abdominal muscles by the exercising person during performance of the resistance-based exercise.

2. The apparatus of claim 1, wherein the instability caused by said compressible member requires continuous adjustment of lower back muscles by the exercising person.

3. The apparatus of claim 1, wherein the support member comprises a seat which engages the person's buttocks and which comprises said compressible member.

4. The apparatus of claim 1, wherein the support member comprises a back portion which engages the person's back and which comprises said compressible member.

5. The apparatus of claim 3, wherein the support member comprises a portion which engages the person's back torso and which comprises said compressible member.

6. The apparatus of claim 3, wherein the support member comprises a portion which engages the person's front torso and which comprises said compressible member.

7. The apparatus of claim 1, wherein said exercise apparatus is an exercise machine dedicated to a press exercise or seated rowing exercise, a lat machine, a strength-training machine, a plate-loaded machine, a weight-stack machine, a multi-station machine; a circuit-training machine, cardiovascular equipment, or a bench.

8. A compressible member overlying at least a portion of a support member, said compressible member being constructed such that, when said apparatus is in use during exercise, the compressible member causes physical instability that requires continuous adjustment of abdominal muscles by the exercising person during performance of the resistance-based exercise, and wherein said support member comprises a pad or seat.

9. The compressible member of claim 8, wherein said compressible member contains a liquid, gel or gas, or combinations thereof.

10. The compressible member of claim 8, wherein said compressible members are available, or packaged for sale, as one or more pads with different degrees of thickness and/or compressibility.

11. A method of enhancing exercise on an exercise apparatus comprising:

(a) a support member comprising a pad or seat for supporting at least a portion of the torso or buttocks, or both, of a person who is exercising;

(b) means associated with said support member for providing strength-enhancing physical resistance when used for exercise by said person; and (c) a compressible member overlying at least a portion of the support member, said compressible member being constructed such that, when said apparatus is in use during exercise, said compressible member causes physical instability that requires continuous adjustment of abdominal muscles by the exercising person during performance of the resistance-based exercise, wherein said method comprises providing a compressible member that is constructed such that, when said exercise apparatus is in use during exercise, the said compressible member causes physical instability that requires continuous adjustment of core muscles by the exercising person.

12. The method of claim 11, wherein said exercise apparatus is an exercise machine dedicated to a press exercise or seated rowing exercise, a lat machine, a strength-training machine, a plate-loaded machine, a weight-stack machine, a multi-station machine; a circuit-training machine, cardiovascular equipment, or a bench.

* * * * *

US008123663C1

(12) EX PARTE REEXAMINATION CERTIFICATE (9609th)

United States Patent
Fey et al.

(10) Number: US 8,123,663 C1
(45) Certificate Issued: Apr. 23, 2013

(54) EXERCISE APPARATUS AND APPAREL

(76) Inventors: Edward G. Fey, Boston, MA (US); Michael R. D'Angelo, Boston, MA (US)

Reexamination Request:
No. 90/012,683, Sep. 15, 2012

Reexamination Certificate for:

| | |
|---|---|
| Patent No.: | **8,123,663** |
| Issued: | **Feb. 28, 2012** |
| Appl. No.: | **12/226,161** |
| Filed: | **Jun. 11, 2009** |

(21) Appl. No.: 90/012,683

(22) PCT Filed: Apr. 9, 2007

(86) PCT No.: PCT/US2007/008664

§ 371 (c)(1), (2), (4) Date: Jun. 11, 2009

(87) PCT Pub. No.: WO2007/120584

PCT Pub. Date: Oct. 25, 2007

Related U.S. Application Data

(60) Provisional application No. 60/790,964, filed on Apr. 11, 2006.

(51) Int. Cl.
*A63B 21/00* (2006.01)

(52) U.S. Cl.
USPC ..... 482/112; 482/111; 482/113

(58) Field of Classification Search ..... None
See application file for complete search history.

(56) References Cited

To view the complete listing of prior art documents cited during the proceeding for Reexamination Control Number 90/012,683, please refer to the USPTO's public Patent Application Information Retrieval (PAIR) system under the Display References tab.

*Primary Examiner* — Danton Demille

(57) ABSTRACT

The invention provides an exercise apparatus containing a compressible member, which provides physical instability and improves core muscle development in an exercising person. In addition, the invention provides an article of clothing containing a compressible member or material which provides physical instability to a person performing active or passive exercise.

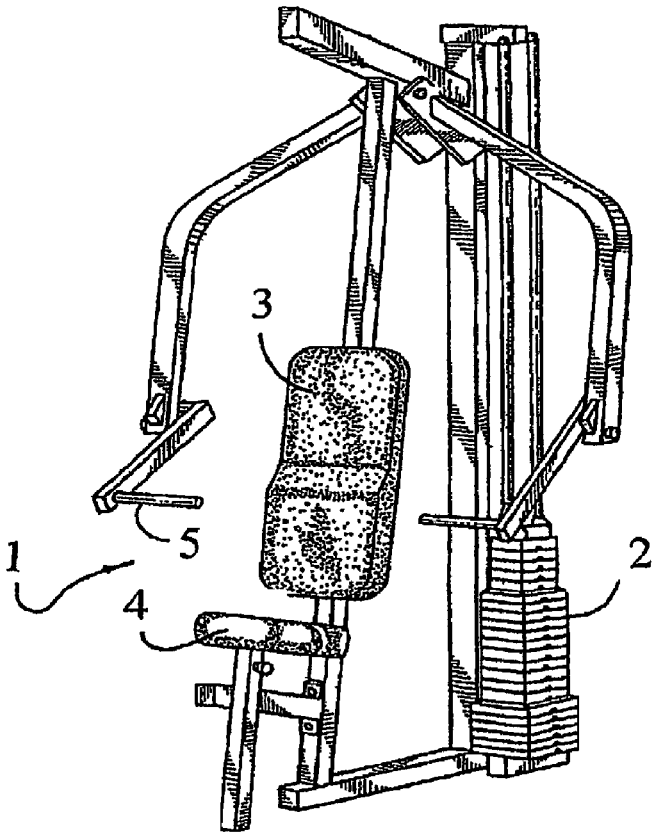

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-12 are cancelled.

* * * * *